US008408396B2

(12) United States Patent
Enkhbold et al.

(10) Patent No.: US 8,408,396 B2
(45) Date of Patent: Apr. 2, 2013

(54) METHOD OF SOLID FUEL BENEFICIATION AND TRANSPORTATION TO THERMOELECTRIC POWER STATIONS

(75) Inventors: Chuluun Enkhbold, Ulaanbaatar (MN); Brodt Alexsander, Beer-sheva (IL)

(73) Assignee: Chuluun Enkhbold (MN)

( * ) Notice: Subject to any disclaimer, the term of this patent is extended or adjusted under 35 U.S.C. 154(b) by 160 days.

(21) Appl. No.: 13/059,984

(22) PCT Filed: Jul. 25, 2008

(86) PCT No.: PCT/IB2008/053003

§ 371 (c)(1),
(2), (4) Date: Feb. 21, 2011

(87) PCT Pub. No.: WO2010/010427

PCT Pub. Date: Jan. 28, 2010

(65) Prior Publication Data

US 2011/0155652 A1 Jun. 30, 2011

(51) Int. Cl.
*B03B 9/00* (2006.01)

(52) U.S. Cl. ..... 209/10; 209/11; 209/172; 209/173; 44/626

(58) Field of Classification Search ..... 209/10, 209/11, 725, 172, 173; 44/280, 281, 626; 110/342, 345

See application file for complete search history.

(56) References Cited

U.S. PATENT DOCUMENTS

| | | | | | |
|---|---|---|---|---|---|
| 4,198,289 | A * | 4/1980 | Elliott et al. | 209/11 |
| 4,249,699 | A * | 2/1981 | Smith et al. | 241/20 |
| 4,376,700 | A * | 3/1983 | Irons | 209/17 |
| 4,392,438 | A * | 7/1983 | Dooley | 110/106 |
| 4,671,800 | A * | 6/1987 | Meyer et al. | 44/281 |
| 4,671,801 | A * | 6/1987 | Burgess et al. | 44/280 |
| 4,765,781 | A * | 8/1988 | Wilks et al. | 406/197 |
| 4,854,937 | A * | 8/1989 | Meyer et al. | 44/280 |
| 5,014,651 | A * | 5/1991 | Cummings | 122/4 D |
| 5,078,752 | A * | 1/1992 | Mach et al. | 48/77 |
| 8,252,070 | B2 * | 8/2012 | Sugita et al. | 44/282 |
| 2011/0150625 | A1 * | 6/2011 | Enkhbold et al. | 414/804 |
| 2011/0173878 | A1 * | 7/2011 | Jeong | 44/620 |

* cited by examiner

*Primary Examiner* — Joseph C Rodriguez
(74) *Attorney, Agent, or Firm* — Galbreath Law Offices, P.C.; John A. Galbreath

(57) ABSTRACT

The invention is a process for the beneficiation and utilization of various kinds of coal and shale oil as a solid fuel for thermoelectric power stations. The beneficiation process is performed underground, near to the place of beneficiation waste stowing, using aqueous salt solution with a density between those of the target component and waste rock. The regeneration of heavy liquid from final beneficiation tailings is performed by washing with non-aqueous volatile liquid, with subsequent drying by the subsurface heat after placing these tailings in the worked-out space. The resulting vapors are compressed and condensed; thus regenerated non-aqueous liquid is returned for washing the beneficiation tailings, while effluents produced by washing are separated into aqueous and non-aqueous components by heat released at the liquefaction of the non-aqueous liquid vapors. The enriched solid fuel remaining in the floatable state is delivered by its flow to the thermo-electric power plant.

2 Claims, 1 Drawing Sheet

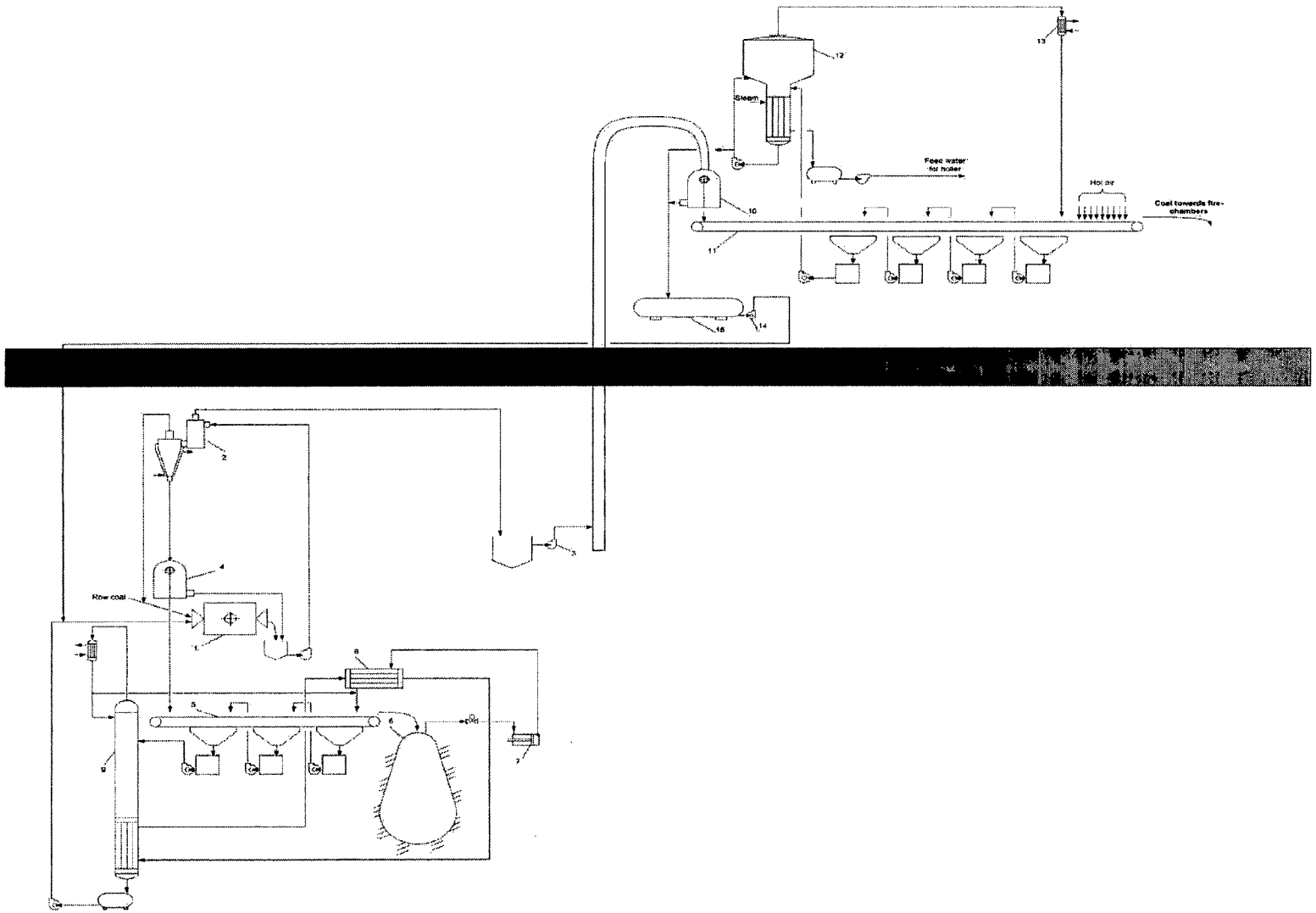
Coal towards fire-chambers
Hot air
Feed water for boiler
Steam
Raw coal

METHOD OF SOLID FUEL BENEFICIATION AND TRANSPORTATION TO THERMOELECTRIC POWER STATIONS

TECHNICAL FIELD

The present invention relates to mining and utilization of fossil energy minerals and can be applied to the beneficiation of various kinds of coal and shale oil produced for using as a solid fuel for thermoelectric power stations.

BACKGROUND ART

A gravitational method of beneficiation of coal to be used for power generation is known (see, for example, Mitchell, D. R. Coal Preparation, New York: American Institute of Mining, 1950; Tsiperovich M. V. Coal beneficiation in heavy media, Moscow: Metallurgizdat, 1953).

According to this method, rock mass produced in the coalface is delivered by underground mine transport to the shaft bottom and then lifted to the surface using mine pulling unit, crushed and submerged into a liquid medium with the density intermediate between those of the fossil fuel and the waste rock, which represents powdery magnetite suspension in water. As a result, the solid fuel, as the lightest component of this system, floats in this heavy medium, whereas the waste rock sinks.

After the extraction of beneficiation products out of the heavy medium and regeneration of magnetite suspension residues carried out to the surface, the enriched solid fuel is dried and delivered by railway or other transport to a thermoelectric power station for combustion, whereas humid beneficiation rejects are either stored on the ground surface in the form of waste piles or, in order to prevent land alienation and ground surface subsidence, lowered back into the mine, transported to the backfilling place and located wet in the mined-out space.

The above method is characterized by obviously unpractical power consumption for drawing waste rock from the coal mine to the surface as a part of rock mass and for bringing back waste beneficiation products to the place of their placement in the mined-out space, as well as by an intense environment pollution with coal dust during numerous transfers and transportations of the enriched solid fuel by railway to a thermoelectric power station owing to a strong blowing-out of dusty fractions of this dry free-flowing material by the wind.

The closest to the method of the present invention is a method of solid fuel beneficiation consisting in the stratification of minerals composing crushed rock mass in a true aqueous medium representing a solution of some soluble mineral salt in water, whose density is intermediate between those of the target component and waste rock, with subsequent extraction of beneficiation products, their washing with water from concomitant residues, evaporation of the obtained flows and return of the regenerated heavy water-salt medium to the starting point of the technological process (see, for instance, 'Washing coal: Patent 1724 Great Britain, Cl. 82').

However, the described method is characterized by a significant irreversible water consumption caused by the outlet of final tailings wetted with water out of the beneficiation system, as well as by high energy consumption for the evaporation of flows formed in the process of washing beneficiation products with water for the regeneration of the heavy water-salt medium.

Besides, the impossibility (for aero-logical reasons) of underground placement of the evaporation facility in the immediate vicinity of the placement of final tailings of beneficiation in the worked-out area, leads to the necessity of the delivery of the entire rock mass volume to the ground surface and, consequently, to the over-expenditure of power resources for the transportation of such an essential fraction of this ballast component.

Meanwhile, the delivery of dry enriched fuel from the ground-based beneficiation plant to the electric power station by railway, as already emphasized, is accompanied by easy blowing of its dusty fractions by the wind, which leads not only to significant loss of the delivered cargo, but also to an intense environment pollution with fuel dust, especially in places of transfer of this dusty material.

DISCLOSURE OF INVENTION

Technical Problem

Technical Solution

The object of the present invention is to reduce the energy consumption of mining energy generation, to eliminate solid fuel loss, to reduce irreversible water consumption and to protect the natural environment from pollution with dusty fuel.

This object is achieved by realizing the beneficiation process in the immediate proximity to the place of beneficiation waste stowing using aqueous liquid with the density intermediate between those of the target component and waste rock, with its regeneration from final beneficiation tailings by washing with non-aqueous light-volatile liquid, with subsequent (after their placement in the worked-out area) drying by the subsurface heat, condensation of waste vapors with their concomitant compression, and separation of effluents after their washing with non-aqueous liquid into aqueous and non-aqueous components by heat released at the liquefaction of its vapors, wherein the enriched solid fuel remaining in the floatable state is delivered in its flow to a thermoelectric power plant, where it is washed with water, dried and directed to combustion, whereas the effluents remaining from its washing with water are evaporated with heat released at the condensation of the working medium of the thermodynamic cycle of a thermoelectric power station, mixed with liquid medium left from carrying solid fuel to the thermoelectric power station, and returned to the starting point of the technological process.

Solutions of both individual mineral salts in water, such as, for instance, calcium chloride, zinc chloride, ferric iron chloride, calcium nitrate, antimony chloride, calcium bromide, zinc bromide, and their various mixtures can be used as the heavy aqueous liquid whose density is intermediate between those of the fuel component of the rock mass and waste rock.

Various organic solvents with the necessary set of rheological, thermodynamic and chemical properties, for instance, acetone, ethyl alcohol, diethyl ether, ethyl bromide, tetrafluorodibromethane and other non-toxic volatile organic compounds, as well as their mixtures possessing moderately low boiling temperatures can be used as non-aqueous easily evaporable liquid for washing final beneficiation tailings from the residues of heavy water-salt medium.

The technology of separate regeneration of heavy aqueous liquid from the products combined with totally in-line operation of the entire fuel-power generation complex allows not only a complete closure of such production cycle over the working medium applied in it, but also an operative arrangement of the total volume of drained final beneficiation tailings in the worked-out area. The achieved ecological cleanness of the process is ensured without using any additional qualified energy supplies. In this case, not only water consumption is reduced, but also any mechanical loss of enriched solid fuel during its delivery to its destination is practically totally excluded, and environmental pollution by its dusty fractions is prevented.

Thus, all distinctive features of the invention are organically interconnected, and only their totality can ensure the accomplishment of the object of the invention. The analysis of all information on the topic published in scientific and technical literature and reveal of the essence of engineering solutions forming the basis of the inventions found as a result of patent search have shown the absence of any methodological similarity between main technological features of the technological process of the invention and distinctive features of known methods of solid fuel beneficiation and transportation. Thus, the present invention possesses not only novelty, but also an essential character of its distinctions imparting a number of technical and economic advantages to the method of the invention, which favorably distinguish it fro known engineering solutions in the field of solid fuel beneficiation and transportation.

Advantageous Effects

DESCRIPTION OF DRAWINGS

The method is realized by a consecutive accomplishment of the following principal operations:

grinding of the initial rock mass down to the threshold of exposing the component minerals;

gravitational separation of solid fuel from waste rock in an aqueous liquid with the density intermediate between those of the components to be separated, organized in the immediate vicinity of beneficiation waste arrangement in the worked-out area;

hydro-mechanical squeezing of final beneficiation tailings from the heavy aqueous liquid;

cleaning of squeezed final beneficiation tailings by a non-aqueous easily evaporating liquid extracting aqueous phase residues from their surface;

stowage of final tailings impregnated with non-aqueous easily evaporating liquid into the worked-out underground space and their drying by the heat of the enclosing rocks;

liquefaction of effluent vapors released by dried material by their compression and condensation and recovery of thus regenerated non-aqueous easily evaporating liquid into the cycle of cleaning final beneficiation tailings;

separation of flows formed at the cleaning of final tailings into aqueous and non-aqueous components by the heat released during the compression and condensation of vapors of the regenerated non-aqueous easily evaporating liquid;

delivery of enriched solid fuel remaining afloat in the aqueous liquid to a thermo-electric power station in the flow of said liquid;

hydro-mechanical squeezing of solid fuel delivered to its destination from the liquid medium;

cleaning of dehydrated solid fuel with water from impregnating residues of the liquid medium;

evaporation of effluents of solid fuel cleaning by heat released at the condensation of working medium of thermodynamic cycle of the thermoelectric power station;

return of evaporated effluents together with the liquid medium left after the squeezing of solid fuel delivered to the thermoelectric power station to the place of its production and beneficiation.

EXAMPLE

The essence of the invention is clarified by an example of its realization illustrated by a flowchart of such integrated fuel and energy complex (see FIG. 1).

The initial rock mass arriving from the mining face is crushed in tumbling mill 1 flooded with aqueous liquid with the density intermediate between those of solid fuel and waste rock operating in a closed cycle with a three-product heavy-medium hydrocyclone 2.

Said aqueous liquid represents an aqueous solution of calcium nitrate mixture with zinc chloride with the density 1.48 g/cm$^3$.

An enriched finished product leaving hydro-cyclone 2 remains suspended in its heavy aqueous medium and is floated, first, to the shaft bottom and then delivered by means of pump 3 and then—ground-based pumping stations (not shown in the FIGURE) to its final destination place—thermoelectric power station.

Concretions of solid fuel with waste rock incompletely opened in the process of wet crushing are removed from the second section of hydro-cyclone 2 and returned for additional crushing to tumbling mill 1. Waste rock extracted from this technological flow is removed out of its conical part cooled by an external cooling medium (which leads to an increase in the aqueous liquid density) and directed to dehydration in centrifuge 4.

Final tailings squeezed on it are subjected to a countercurrent washing with non-aqueous easily evaporable liquid—acetone—realized in band vacuum filter 5 and supplied for stowage in underground excavation 6.

After a complete filling of the underground excavation 6 volume with such humid stowing material, final tailings are embedded in it, and it is connected to the suck-in of compressor 7, which pumps out the vapors of easily evaporating non-aqueous liquid evaporating from their surface under the action of geothermal heat of the subsurface.

Organic vapors compressed in compressor 7 are directed to condenser 8, where they are liquefied. Easily evaporable non-aqueous liquid regenerated in this way is returned again to the washing of final beneficiation tailings from the aqueous liquid phase impregnating them.

The resulting effluents, which represent a mixture of an organic liquid with a water-salt medium, are directed to distillation in rectification column 9, whose distillatory part is heated with hot water extracting the heat of compression and condensation of organic vapors liquefied in condenser 8. As a result of distillation, this mixture is divided into the initial aqueous liquid with the density exceeding that of the solid fuel, which is returned to the beneficiation process, and the regenerated non-aqueous organic easily evaporable liquid, which is directed again to the cleaning of waste beneficiation products from the residues of the aqueous liquid phase impregnating them.

Enriched material delivered to a thermoelectric power station in an aqueous liquid flow is subjected to analogous operations, with the only difference that water is used for its cleaning, and not non-aqueous organic easily evaporable liquid.

For this purpose, solid fuel pipelined to its destination place is, first of all, cleared from the liquid medium, which has delivered it, in centrifuge 10, and then washed with hot water in a counter-current mode in band vacuum filter 11. It is dried with hot air at the outlet of band vacuum filter 11 and directed to combustion in the furnace of thermoelectric power station.

Washing water left after its washing, which represents a dilute solution of a mixture of mineral salts in water, is evaporated in evaporating system 12 heated with exhaust steam of steam turbines, which is a working medium of the thermodynamic cycle of the conversion of solid fuel combustion heat into the electric power in a thermoelectric power station. Therefore, the condensate formed in the inter-tube space of steam-generating tubes of evaporating system 12 is pumped again into the steam-boiler of a thermoelectric power station, where it is processed again into a high-pressure operating steam.

Meanwhile, juice water steam from the evaporated solution leaving evaporating system 12 is fed to condenser 13 for condensation, where it becomes a condensate, which is used again as hot washing water for counter-current solid fuel clearing from the residues of impregnating water-salt solution after squeezing in centrifuge 10.

The solution evaporated up to the initial density in evaporating system 12 is mixed with centrifugate left after the solid fuel dehydration in centrifuge 10 and fed back to the place of solid fuel production and beneficiation by a chain of transfer pumps 14 (only one of them shown in the diagram).

The use of the proposed method provides a number of significant advantages in comparison with known methods of solid fuel beneficiation and transportation to a thermoelectric power station. They consist in a decrease in power consumption by the entire mining and power generation industry, which represents in this case a single technological complex owing to a refusal to deliver waste rock as a part of rock mass from a mine to the ground surface and to the organization of a completely in-line technological process, from solid fuel production and beneficiation to its delivery to a thermoelectric power station for combustion. Besides, such industry is not accompanied with deleterious effect of fuel dust on the natural environment and is characterized by a reduction of irreversible water consumption.

Best Mode

Mode for Invention

Industrial Applicability

Sequence List Text

The invention claimed is:

1. A method of solid fuel beneficiation and transportation to a thermo-electric power station, comprising the steps of:

separating minerals constituting a rock mass into a solid fuel using a heavy aqueous liquid, placing final beneficiation tailings from said separating step into a worked-out area, subsequently regenerating said heavy aqueous liquid from the final beneficiation tailings and returning the heavy aqueous liquid for re-use in said separating step, wherein said regenerating of the heavy aqueous liquid from the final beneficiation tailings includes:

washing the final beneficiation tailings with a non-aqueous liquid, drying the final beneficiation tailings with a subsurface heat source, liquifying vapors of said heavy aqueous liquid conning from the final beneficiation tailings, distilling effluents left after washing the final beneficiation tailings into aqueous and non-aqueous components using heat released by liquifying the non-aqueous liquid, delivering the heavy aqueous liquid, and solid fuel remnants floating in the heavy aqueous liquid, to the thermoelectric power station, squeezing the heavy aqueous liquid from the solid fuel remnants, washing the solid fuel remnants with water and directing the solid fuel remnants to a combustion process, evaporating effluents left after washing the solid fuel remnants using heat released by condensing a working medium of a thermodynamic cycle of the thermoelectric power station, combining the effluents left after washing the solid fuel remnants, and the heavy aqueous liquid squeezed from the solid fuel remnants, into a mixture and returning the mixture for re-use in said separating step.

2. The method according to claim 1, wherein a solution of calcium nitrate mixture with zinc chloride is used as the heavy aqueous liquid, said solution having a density between that of the solid fuel and a waste rock, and wherein acetone is used as the non-aqueous liquid.

* * * * *